US005526250A

United States Patent [19]

Ting et al.

[11] Patent Number: 5,526,250

[45] Date of Patent: Jun. 11, 1996

[54] STRUCTURE OF LAMP SOCKET

[76] Inventors: Cheng Y. Ting; Chuang T. Chun, both of P.O. Box 82-144, Taipei, Taiwan

[21] Appl. No.: 344,029

[22] Filed: Nov. 23, 1994

[51] Int. Cl.[6] ..... F21V 21/00

[52] U.S. Cl. ..... 362/391; 362/226; 362/806; 439/419

[58] Field of Search ..... 362/226, 249, 362/252, 391, 396, 806; 439/414, 419

[56] References Cited

U.S. PATENT DOCUMENTS 4,763,232 8/1988 Woodside ..... 362/252
5,330,368 7/1994 Isuruzono ..... 362/226

FOREIGN PATENT DOCUMENTS 672562 10/1963 Canada ..... 362/391

*Primary Examiner* Denise L. Gomada
*Assistant Examiner* Y. Quach
*Attorney, Agent, or Firm* Alfred Lei

[57] ABSTRACT

An improved structure of lamp socket in which the socket body consists of two hinged symmetrical halves retained in shape by a hoop; the positive contact metal plate is made of L-shaped configuration mounted in the top of the socket body on the inside and supported between two inside flanges; the negative contact metal plate is a flat plate vertically laterally disposed inside the socket body and having the bottom end stopped at a receptacle inside the socket body.

1 Claim, 3 Drawing Sheets

STRUCTURE OF LAMP SOCKET

BACKGROUND OF THE INVENTION

The present invention relates to a lamp sockets, and relates more particularly to an improved structure of lamp socket which is easy to assemble and safe in use.

Various decorative strings and Christmas tree light sets are well-known and intensively used in western countries as well as most Asian countries during Christmas holidays. When installed, decorative strings and Christmas tree light sets are controlled to flash and to give different colors of light. The lamp socket for a decorative string or Christmas tree light set generally comprises a socket shell having a positive contact metal plate and a negative contact metal plate, a socket cap fastened to the socket shell to hold down an electrical wire causing the positive and negative contact metal plates respectively pierced into the insulator of the electrical wire and made a respective electrical contact with either conductor of the electrical wire. The positive contact metal plate has a vertical front end inserted through a hole on the top wall of the socket shell and pierced through the insulator of the electrical wire and made an electrical contact with the respective conductor of the electrical wire, and a horizontal rear end disposed inside the socket shell below an inside projecting portion on the top wall of the socket shell. When the base of the lamp bulb is threaded into the socket shell, the ring contact and tip contact of the lamp bulb contact the negative and positive contact metal plates respectively. Under normal condition, the horizontal rear end of the positive contact metal plate is spaced from the projecting portion on the top wall of the socket shell, and therefore it contacts the tip contact of the lamp bulb when the lamp bulb is threaded into the socket shell. When the lamp bulb is threaded into the socket shell, the tip contact of the lamp bulb is spaced from the projecting portion on the top wall of the socket shell at a distance longer than the thickness of the horizontal rear end of the positive contact metal plate. However, the positive contact metal plate tends to cause an elastic fatigue after long uses. Therefore, a contact error happens when the horizontal rear end of the positive contact metal plate is disposed constantly in contact with the projecting portion of the top wall of the socket shell.

SUMMARY OF THE INVENTION

The present invention has been accomplished to provide a lamp socket which eliminates the aforesaid problem. According to one aspect of the present invention, the socket body consists of two hinged symmetrical halves retained in shape by a hoop. This arrangement facilitates the installation of the positive and negative contact metal plates. According to another aspect of the present invention, the positive contact metal plate is made of L-shaped configuration mounted in the top of the socket body on the inside and supported between two inside flanges, the negative contact metal plate is a flat plate vertically laterally disposed inside the socket body and having the bottom end stopped at a receptacle inside the socket body. This arrangement protects the positive and negative contact metal plates from being pulled out of the socket body.

DETAILED DESCRIPTION OF THE PREFERRED EMBODIMENT

Figure 1:
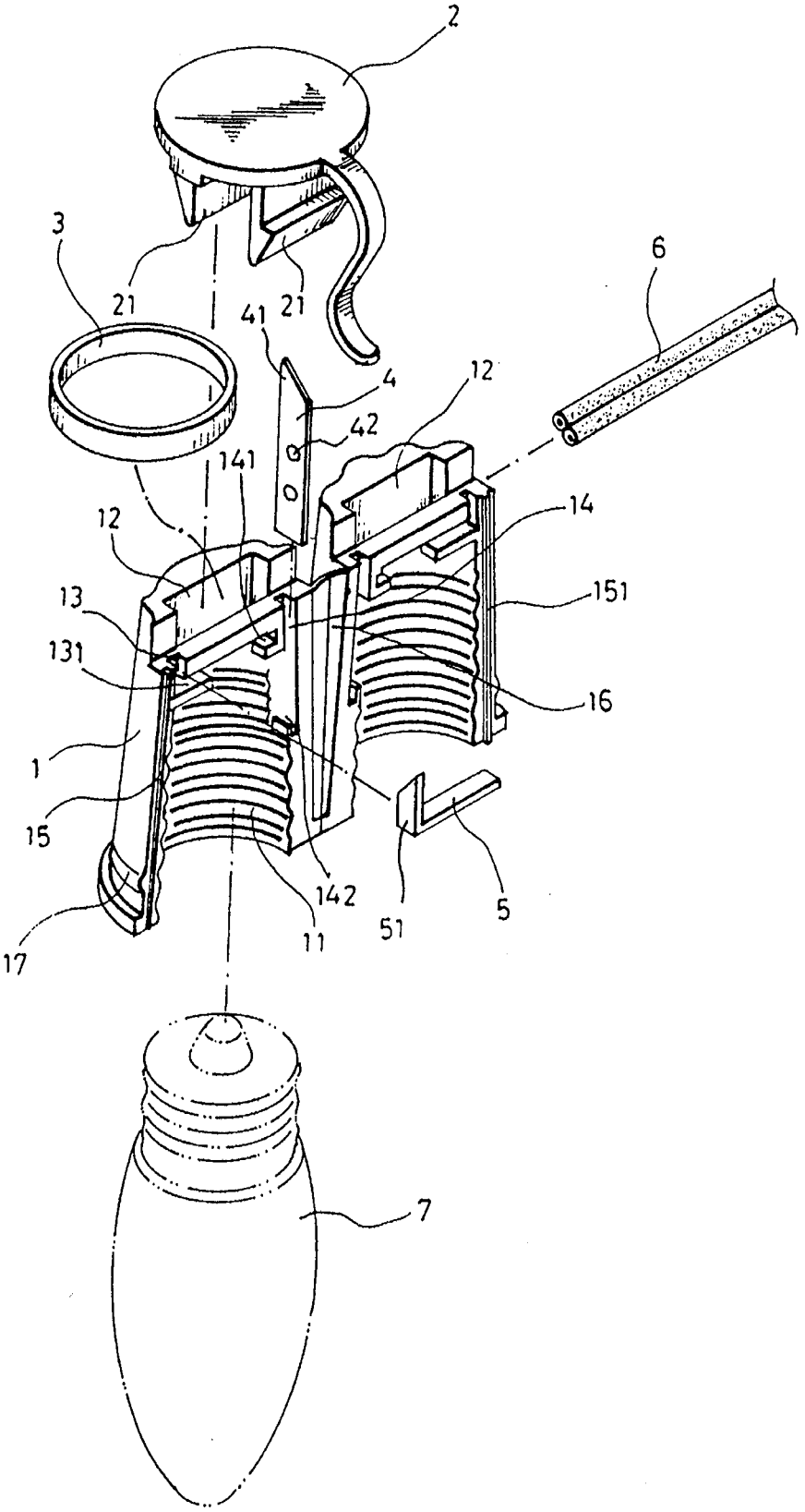
FIG. 1 is an exploded view of a lamp socket according to the present invention.
Figure 2:
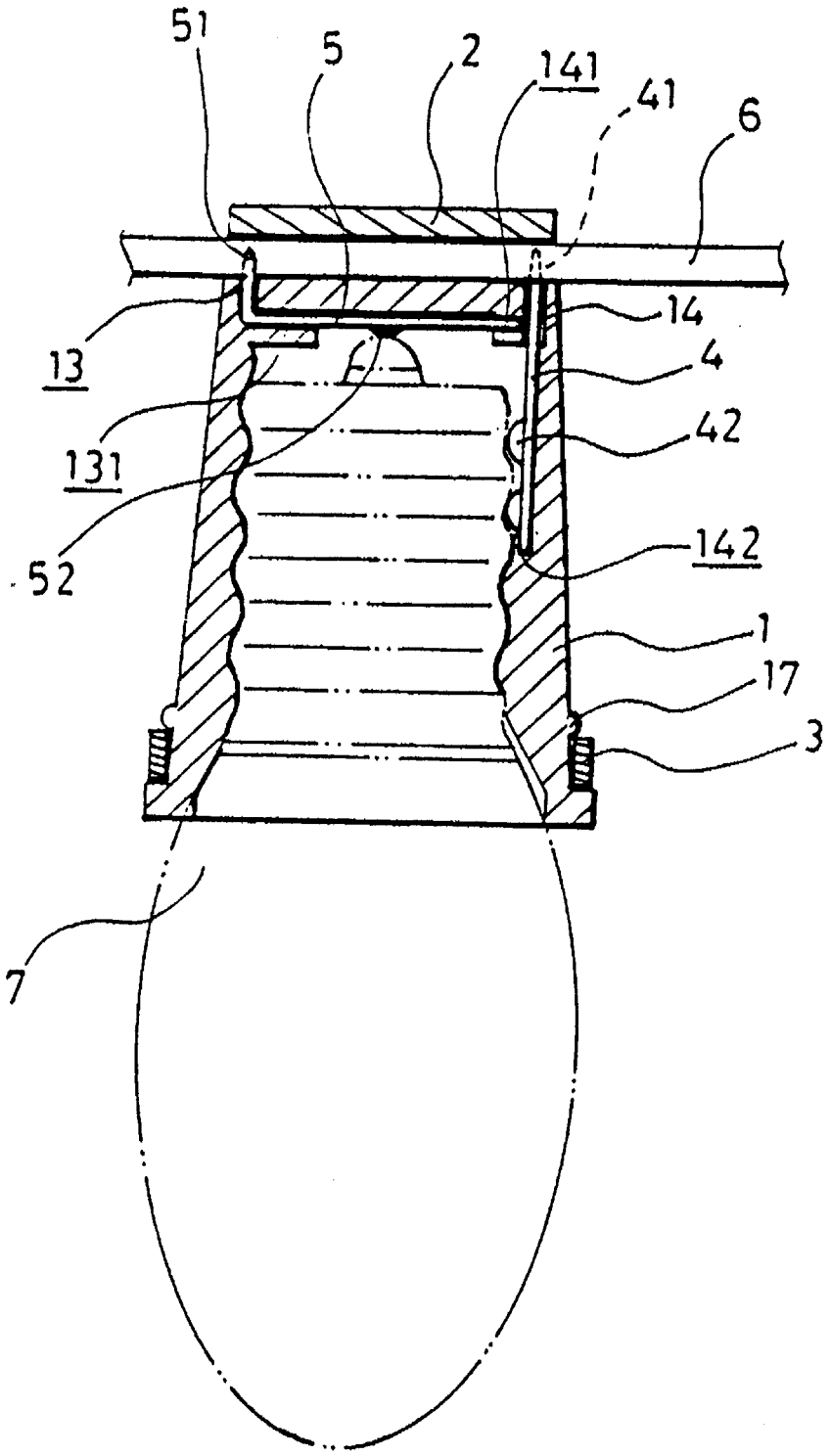
FIG. 2 is a longitudinal view in section of the lamp socket shown in FIG. 1.
Figure 3:
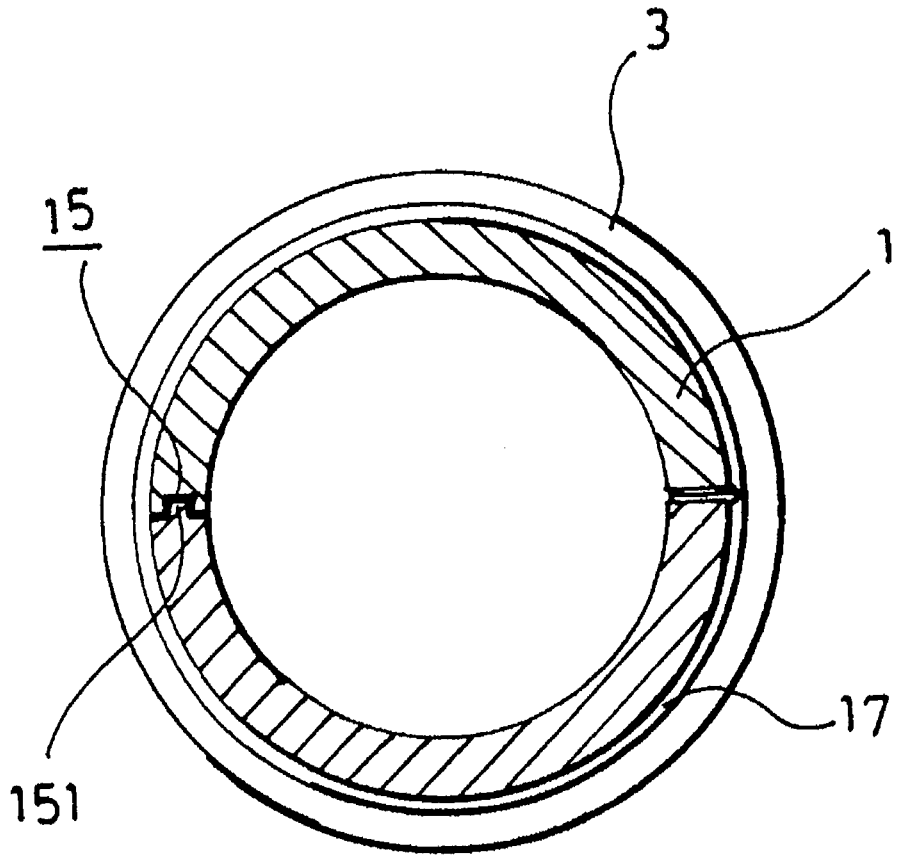
FIG. 3 is a cross section taken on FIG. 2.

Referring to FIGS. 1 and 2, a lamp socket assembly in accordance with the preferred embodiment of the present invention is generally comprised of a socket body 1, a socket cap 2 covered on the hoop 3 at the top to hold down an electric wire 6, a negative contact metal plate 4 and a positive contact metal plate 5 fastened to the socket body 1 on the inside, a bulb 7 fastened to the socket body 1 at the bottom. The socket 1 comprises two chambers 13 and 14 at the top. The positive contact metal plate 5 and the negative contact metal plate 4 have a respective pointed top end 51 or 41 respectively extended out of the chambers 13 and 14 and pierced the electric wire 6 to make a respective electric contact. The socket cap 2 has two bottom hooks 21 hooked in respective retaining holes 12 on the socket body 1.

Referring to FIGS. 1 and 2 again, the socket body 1 is comprised of two symmetrical halves linked by a hinge 16. Each half of the socket body 1 comprises a respective retaining hole 12, a positive contact metal plate chamber 13 and a negative contact metal plate chamber 14 bilaterally longitudinally disposed at the top, a first inside flange 131 corresponding to the positive contact metal plate chamber 13, a second inside flange 141 opposite to the first inside flange 131, a receptacle 142 at the bottom end of the negative contact metal plate chamber 14. The socket body 1 further comprises an annular flange 17 around the outside wall near the bottom, a longitudinal groove 15 and a longitudinal tongue 151 respectively disposed on the symmetrical halves at the open side (opposite to the hinge 16). The positive contact metal plate 5 is made of substantially L-shaped configuration, having a raised contact portion 52 at the bottom. The negative contact metal plate 4 is a flat plate having a plurality of raised contact portions 42 at one side. There is also provided a hoop 3 mounted around the socket body 1 to hold it in shape.

During the assembly process before the two symmetrical halves of the socket body 1 are closed, the L-shaped positive contact metal plate 5 is received in the positive contact metal plate chamber 13 and supported between the first inside flange 131 and the second inside flange 141, and the negative contact metal plate 4 is directly inserted into the negative contact metal plate chamber 14 with its bottom end stopped at the receptacle 142. When the positive and negative contact metal plates 5 and 4 are installed, the two symmetrical halves of the socket body 1 are closed, permitting the tongue 151 to fit into the groove 15, and then the hoop 3 is mounted around the socket body 1 and stopped above the annular flange 17. After the assembly of the socket body 1, the electric wire 6 is fastened to the socket body 1 by the socket cap 2, permitting the hooks 21 of the socket cap 2 to hook in the retaining holes 12. When the socket cap 2 is fastened to the socket body 1, the pointed top ends 51 and 41 of the positive and negative contact metal plates 5 and 4 are forced into the insulator of the electric wire 6 to make a respective electric contact. When the lamp bulb 7 is threaded into the spiral groove 11 of the socket body 1, the tip and ring contacts of the lamp bulb 7 are respectively connected to the raised portion 52 of the positive contact metal plate 5 and the raised portions 42 of the negative contact metal plate 4. Because the bottom end of the negative contact metal plate 4 is stopped at the receptacle 142 and the positive contact metal plate 5 is supported between the inside flanges 131 and 141 at the top, the positive and negative contact metal plates 5 and 4 are protected from being pulled out of the socket body 1.

What is claimed is:

1. A lamp socket comprising a socket body, a socket cap fastened to said socket body to hold down an electric wire wihtin said socket body, a positive contact metal plate and a negative contact metal plate installed in said socket body and respectively connected to the positive and negative poles of said electric wire, and a lamp bulb threaded into said socket body to contact the positive and negative contact metal plates, wherein said socket body is comprised of two symmetrical halves each having one side hinged to each other by a hinge and an opposite side detachably connected together by a tongue-and-groove joint and then retained in shape by a hoop, each half of said socket body comprising a retaining hole to which said socket cap is fastened, a positive contact metal plate chamber and a negative contact metal plate chamber bilaterally longitudinally disposed at a top position of said socket body, a first inside flange disposed in said socket body at a distance relative to said positive contact metal plate chamber, a second inside flange disposed in said body position opposite to said first inside flange, and a receptacle disposed in said socket body at a distance below relative to said second inside flange; said positive contact metal plate is made of substantially L-shaped configuration and inserted into said positive contact metal plate chamber and supported between said first inside flange and said second inside flange, said positive contact metal plate having a raised contact portion at a bottom thereof relative to said wire for electrical connection to a tip contact of the lamp bulb; said negative contact metal plate is a flat plate inserted into said negative contact metal plate chamber, having a bottom end stopped at said receptacle of said socket body and a plurality of raised contact portions for electrical connection to a ring contact of the lamp bulb.

* * * * *